United States Patent [19]

Hackbarth et al.

[11] 3,946,697

[45] Mar. 30, 1976

[54] ENGINE EXHAUST GAS DISCHARGE ARRANGEMENT

[75] Inventors: Eugene R. Hackbarth, Kenosha, Wis.; George E. Miller, Libertyville, Ill.; H. Norman Petersen, Kenosha, Wis.; John D. Sheldon, Zion, Ill.; Harry M. Ward, III, Waukegan, Ill.

[73] Assignee: Outboard Marine Corporation, Waukegan, Ill.

[22] Filed: Nov. 4, 1974

[21] Appl. No.: 520,434

[52] U.S. Cl. ..... 115/.5 E; 60/320; 115/17

[51] Int. Cl.[2] ..... B63H 21/34

[58] Field of Search ..... 115/17, 18 R, 34 R, .5 R, 115/.5 E; 60/320, 272, 310; 181/39

[56] References Cited

UNITED STATES PATENTS

| | | | |
|---|---|---|---|
| 3,045,423 | 7/1962 | Hulsebus | 115/17 |
| 3,310,021 | 3/1967 | Shimanckas | 115/17 |
| 3,577,952 | 5/1971 | Tado | 115/17 |
| 3,692,006 | 9/1972 | Miller et al. | 115/17 |

*Primary Examiner*—Trygve M. Blix
*Assistant Examiner*—Charles E. Frankfort
*Attorney, Agent, or Firm*—Michael, Best & Friedrich

[57] ABSTRACT

Disclosed herein is an engine block including first wall portions defining a combustion chamber, second wall portions defining a bore including a first portion extending from the combustion chamber and a second portion enlarged with respect to the first portion, third wall portions defining a water jacket in cooling relation to the second wall portions, and an elongated duct of heat resistant material communicating through the first bore portion with the combustion chamber so as to receive exhaust gases discharged therefrom, which duct is circumferentially engaged by and supported from the second wall portion at locations spaced lengthwise of the duct and extends in the enlarged bore portion in spaced relation from the second wall portions intermediate the locations, whereby there is provided a stagnant air space between the duct and the block intermediate the locations so as to reduce heat transmission from the duct.

9 Claims, 3 Drawing Figures

ENGINE EXHAUST GAS DISCHARGE ARRANGEMENT

BACKGROUND OF THE INVENTION

The invention relates generally to internal combustion engines, and, more particularly, to exhaust gas systems and arrangements for such engines.

The invention also relates to outboard motors and to engines and exhaust gas discharge arrangements for such outboard motors.

The invention also relates to diminishing discharge of unburned combustibles into the atmosphere by facilitating combustion thereof in the exhaust pipe prior to discharge.

SUMMARY OF THE INVENTION

The invention provides an engine comprising an engine block including first wall means defining a combustion chamber, together with second wall means defining a bore including a first portion extending from the combustion chamber and a second portion enlarged with respect to the first portion and closed to the atmosphere, together with an elongated duct of heat resistant material communicating through the first bore portion with the combustion chamber so as to receive exhaust gases discharged therefrom. In addition, the duct is circumferentially engaged by, and supported from, the second wall means at locations spaced lengthwise of the duct and extends in the enlarged bore portion in spaced relation to the second wall means intermediate the supported locations, whereby there is provided a stagnant air space between the duct and the block intermediate the locations so as to reduce heat transmission from the duct.

In accordance with a preferred embodiment of the invention, the engine block also includes third wall means defining a water jacket in heat-exchanging relation to the second wall means.

The invention also provides an outboard motor comprising a propulsion unit which includes a drive shaft housing having, at the bottom thereof, a gear box rotatably supporting a propeller shaft carrying a propeller, and also having an exhaust gas discharge outlet normally located under water, and which further includes an engine block member including first wall means defining a combustion chamber and second wall means defining a bore including a first portion extending from the combustion chamber and a second portion enlarged with respect to the first portion and substantially closed to the atmosphere, together with an exhaust pipe which is of heat resistant material, which communicates with the combustion chamber so as to receive exhaust gases discharged therefrom, which is circumferentially engaged by and supported from the second wall means at locations spaced lengthwise of the pipe, and which extends in the enlarged bore portion in spaced relation from the second wall means intermediate the supporting locations, whereby there is provided a stagnant air space between the pipe and the member intermediate the supporting locations so as to reduce heat transmission from the pipe. Still further in addition, the pipe also communicates through the drive shaft housing with the exhaust gas discharge outlet.

In a preferred embodiment in accordance with the invention, the outboard motor engine block member further includes third wall means defining a water jacket in cooling relation to the second wall means.

Also in accordance with a preferred embodiment of the invention, the exhaust pipe in the outboard motor includes a horizontal section and a vertical section and the first mentioned stagnant air space is located in surrounding relation to the horizontal section and the second wall means includes additional means supporting the vertical exhaust pipe section and defining a second stagnant air pocket surrounding the vertical exhaust pipe section.

One of the principal features of the invention is the provision of a stagnant air pocket located around a heat resistant exhaust gas pipe and in adjacent relation to the combustion chamber so as to reduce heat transmission from the exhaust gas pipe and thereby facilitate combustion in the exhaust gas pipe of unburnt combustibles in the exhaust gas discharged from the combustion chamber.

Another of the principal features of the invention is the provision of an outboard motor in which the exhaust gas is discharged through water and including an exhaust gas pipe which is fabricated of heat resistant material, which communicates with the combustion chamber and with an underwater discharge, and which extends through one or more stagnant air pockets located in the engine block assembly in relatively close relation to the combustion chamber so as to diminish heat transmission from the exhaust pipe and thereby facilitate burning of any unburnt combustible in the exhaust gas discharged from the combustion chamber.

Another of the principal features of the invention is the provision of an outboard motor as referred to in the preceding paragraphs and in which the exhaust pipe includes an angular bend located in a stagnant air pocket.

Other features and advantages of the invention will become known by reference to the following drawings, general description, and claims.

THE DRAWINGS

Figure 1:
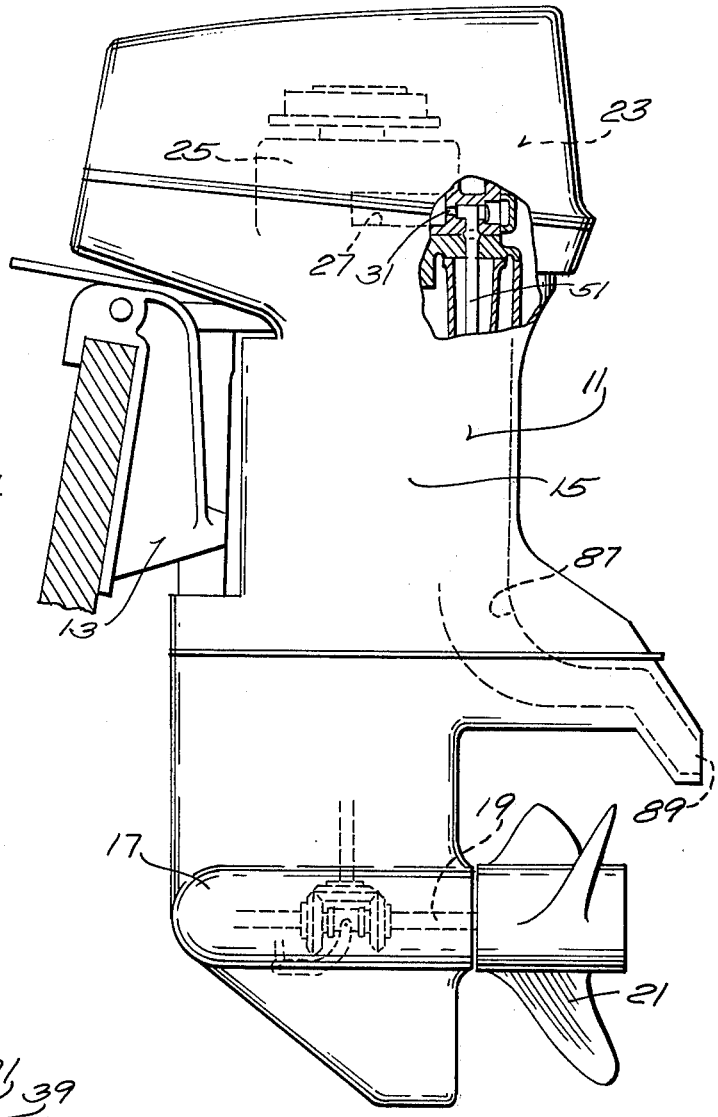
FIG. 1 is a partially schematic, partially broken away, side elevational view of an outboard motor embodying various of the features of the invention.
Figure 2:
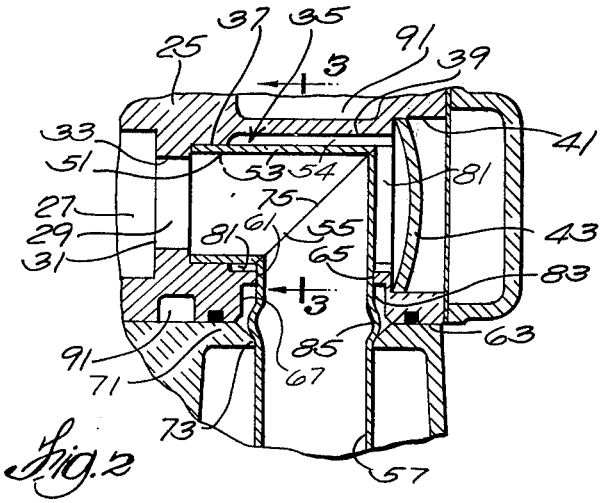
FIG. 2 is an enlarged view showing a portion of the outboard motor shown in FIG. 1.
Figure 3:
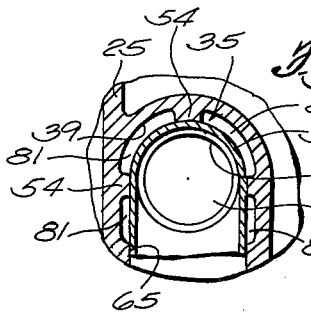
FIG. 3 is a fragmentary sectional view taken along line 3—3 of FIG. 2.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is an outboard motor including a propulsion unit 11 and means 13 adapted to be connected to a boat and connected to the propulsion unit 11 to afford vertical tilting and horizontal steering movement of the propulsion unit 11 relative to the boat.

The propulsion unit 11 comprises a vertically extending drive shaft housing 15 including, at the lower end thereof, a gear box 17 which rotatably supports a propeller shaft 19 carrying a propeller 21.

Mounted rigidly to the top of the drive shaft housing 15 is an engine 23 including a block or member 25 having wall means defining a combustion chamber 27 having therein a moving piston (not shown) generating a rotary output.

Also included in the engine block 25 is a second wall means defining a horizontally extending bore 29 which communicates with the combustion chamber 27 to provide an exhaust gas port 31 for discharge therethrough of spent products of combustion.

The horizontal bore 29 includes a first portion 33 extending from the combustion chamber 27 and an enlarged second portion 35 which includes a first counter bore 37 extending from the first bore portion 33 and a second counter bore 39 which is enlarged with respect to the first counter bore 37. Extending from the second counter bore 39 is still another larger or third counter bore 41 which extends to the exterior of the block 25 and which is adapted to receive a plug 43 sealing the bore 29 from the atmosphere.

Communicating with the first bore portion 33 is an exhaust duct or pipe 51 which is fabricated of heat resistant material, such as stainless steel, and which includes a horizontal section 53 fixedly seated in continuous circumferential engagement in the first counter bore 37. The inside dimension of the horizontal exhaust pipe section 53 is preferably approximately the same as that of the first bore portion 33 to afford smooth exhaust gas flow from the first bore portion 33 into the exhaust pipe 51. In addition, the horizontal exhaust pipe section 53 projects into the second counter bore 39 in spaced relation to the walls which define the second counter bore 39 and is supported by circumferentially spaced ribs 54 defined by the second wall means and extending axially of the bore in engagement with the pipe section 53. Because it is preferred to discharge the exhaust gases under water, the horizontal exhaust pipe section 53 terminates with an outer end 55 extending at a 45° angle to afford abutting engagement with a vertically extending exhaust pipe section 57 still to be described.

In order to facilitate mounting of the vertical exhaust pipe section 57, the block or member 25 includes third wall means defining a second or vertical bore 61 which intersects the second counter bore 39 of the second portion 35 of the horizontal bore 29 and which terminates in a generally horizontal face 63 of the engine block or member 25. The second or vertical bore 61 includes an upper portion 65 and a lower adjacent portion 67 which is of larger cross section than the upper portion 65 and which terminates at the horizontal face 63.

Connected to the face 63 of the block or member 25 is either a portion of the drive shaft housing 15 or another member 71 which is sandwiched between the member 25 and the drive shaft housing 15 and which includes a third vertical bore 73 aligned with and of generally the same size as the upper portion 65 of the second or vertical bore 61.

Extending in the aligned bores 61 and 73 in the members 25 and 71 is the vertical exhaust gas pipe section 57 which terminates, at its upper end 75, at an angle of 45° so as to abuttingly engage the outer end 55 of the horizontal exhaust pipe section 53 to provide a continuous passage or duct which extends through a right angle.

The upper portion 65 of the second or vertical bore 61 continuously circumferentially engages the vertically extending exhaust pipe section 57 so as to establish an upper dead air space 81, pocket, or void, in the member or block 25 around the projecting part of the horizontally extending exhaust gas pipe section 53.

In addition, the bore 73 in the member 71 preferably continuously circumferentially engages the vertically extending exhaust pipe section 57 so as to provide a lower stagnant or dead air pocket or void or space 83 in the enlarged bore portion 67 located around the vertically extend exhaust pipe section 57. Desirably, the adjacent margins of the upper and lower bores 67 and 73 extending from the face 63 in the members 25 and 71 respectively are chamfered and the vertically extending exhaust pipe section 57 includes an angular outwardly extending ripple 85 preventing downward movement of the pipe section 57 and thereby maintaining abutting engagement of the section ends 55 and 75.

At its lower end, the exhaust pipe 51 communicates through any suitable passage means 87 with an under water discharge outlet 89 such as, for instance, the illustrated snout or an exhaust gas discharge in the hub of a propeller (not illustrated). If desired, the lower part of the exhaust pipe 51 and the passage means 87 in the drive shaft housing 15 can be water jacketed as is taught for instance in the U.S. Larsen Pat. No. 3,198,162, issued Aug. 3, 1965.

Also included in the block or member 25 is a further wall means providing a water jacket 91 which is located in cooling or heat exchanging relation to the wall means defining the horizontally and vertically extending bores 29 and 61, respectively.

There is thus provided adjacent to the combustion chamber an exhaust pipe which is constructed of heat resistant material and which is surrounded, in part, by a substantially stagnant air jacket or void (either the jacket 81 or 83, or both) which diminishes heat transfer to the adjacent walls of the member 25, which walls, in turn, are water cooled to prevent over-heating thereof. Consequently, heat retention in the exhaust pipe 51 is maximized without over-heating of the walls of the member 25.

While the disclosed construction includes two stagnant air pockets 81 and 83, the invention is not limited to two pockets and extends to constructions employing a single stagnant air pocket.

In addition, although the disclosed and preferred construction includes use of a right angle exhaust pipe bend within a stagnant air pocket, the invention is not so limited and extends to the use of a stagnant air pocket around a straight exhaust gas pipe.

If desired, means can be provided for supplying combustion air to the exhaust pipe 51 in the area adjacent to the combustion chamber so as to facilitate burning of combustibles in the exhaust gas.

Various of the features of the invention are set forth in the following claims:

What is claimed is:

1. An engine comprising an engine block including first wall means defining a combustion chamber, and second wall means defining a bore including a first portion extending from said combustion chamber and a second portion enlarged with respect to said first portion and substantially closed from the atmosphere, and an elongated duct of heat resistant material communicating through said first bore portion with said combustion chamber so as to receive exhaust gases discharged therefrom, said duct being longitudinally engaged by and supported from said second wall means at locations spaced circumferentially of said duct and extending in said second bore portion in spaced relation from said second wall means intermediate said locations, said duct and said second bore portion defining therebetween an air space which is stagnant during operation so as to reduce heat transmission from said duct.

2. An engine in accordance with claim 1 wherein said engine block further includes third wall means defining a water jacket in cooling relation to said second wall means.

3. An engine in accordance with claim 1 wherein said duct includes a horizontal section and a vertical section and wherein said first mentioned air space is located in surrounding relation to said horizontal section and wherein said second wall means includes additional means supporting said vertical section and defining a second stagnant air pocket surrounding said vertical section.

4. An outboard motor comprising a propulsion unit including a drive shaft housing including, at the bottom thereof, a gear box rotatably supporting a propeller shaft carrying a propeller, said drive shaft housing also including an exhaust gas discharge outlet which is normally located under water, said propulsion unit further including an engine block member including first wall means defining a combustion chamber, and second wall means defining a bore including a first portion extending from said combustion chamber and a second portion enlarged with respect to said first portion and substantially closed to the atmosphere, and an elongated pipe of heat resistant material communicating through said first bore portion with said combustion chamber so as to receive exhaust gases discharged therefrom, said pipe being longitudinally engaged by and supported from said second wall means at locations spaced circumferentially of said pipe and extending in said second bore portion in spaced relation from said second wall means intermediate said locations, said duct and said second bore portion defining therebetween an air space which is stagnant so as to reduce heat transmission from said pipe, said pipe also communicating through said drive shaft housing with said exhaust gas discharge outlet.

5. An outboard motor in accordance with claim 4 wherein said block member further includes third wall means defining a water jacket in cooling relation to said second wall means.

6. An outboard motor in accordance with claim 4 where said pipe includes a horizontal section and a vertical section and wherein said first mentioned air space is located in surrounding relation to said horizontal section and wherein said second wall means includes additional means supporting said vertical section and defining a second stagnant air pocket surrounding said vertical section.

7. An engine comprising an engine block including first wall means defining a combustion chamber, and second wall means defining a bore including a first portion extending from said combustion chamber and a second portion enlarged with respect to said first portion and substantially closed from the atmosphere, and an elongated duct of heat resistant material communicating through said first bore portion with said combustion chamber so as to receive exhaust gases discharged therefrom, said duct being engaged by and supported from said second wall means and extending in said second bore portion in spaced relation from said second wall means, said duct and said second bore portion defining therebetween an air space which is stagnant during operation so as to reduce heat transmission from said duct.

8. An engine in accordance with claim 7 wherein said engine block further includes third wall means defining a water jacket in cooling relation to said second wall means.

9. An engine in accordance with Claim 7 wherein said duct includes a horizontal section and a vertical section and wherein said first mentioned air space is located in surrounding relation to said horizontal section and wherein said second wall means includes additional means supporting said vertical section and defining a second stagnant air pocket surrounding said vertical section.

* * * * *